US006592068B2

(12) United States Patent
Taylor et al.

(10) Patent No.: US 6,592,068 B2
(45) Date of Patent: Jul. 15, 2003

(54) CORELESS ROLL PRODUCT ADAPTER AND DISPENSER

(75) Inventors: Antwain D. Taylor, Suwanee, GA (US); Randall M. Bachtel, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/003,716

(22) Filed: Oct. 31, 2001

(65) Prior Publication Data

US 2003/0080237 A1 May 1, 2003

(51) Int. Cl.[7] ..... B65H 16/06; B65H 49/18

(52) U.S. Cl. ..... 242/596.8; 242/594.4; 242/599.3

(58) Field of Search ..... 242/596, 596.1, 242/596.3, 596.5, 596.7, 596.8, 594, 594.4, 594.5, 598.3, 598.5, 599.3, 520

(56) References Cited

U.S. PATENT DOCUMENTS

| | | | | |
|---|---|---|---|---|
| 2,879,012 A | | 3/1959 | Sarro | |
| 4,307,639 A | | 12/1981 | DeLuca | |
| 4,340,195 A | | 7/1982 | DeLuca | |
| 4,375,874 A | | 3/1983 | Leotta et al. | |
| 4,564,148 A | | 1/1986 | Wentworth | |
| 4,627,560 A | | 12/1986 | Samuelson | |
| 4,762,288 A | | 8/1988 | Eckels | |
| D327,192 S | | 6/1992 | Geuvjehizian | |
| 5,253,818 A | | 10/1993 | Craddock | |
| 5,370,336 A | | 12/1994 | Whittington | |
| 5,467,935 A | | 11/1995 | Moody | |
| 5,468,332 A | | 11/1995 | Dretzka | |
| 5,495,997 A | * | 3/1996 | Moody | 242/560 |
| 5,577,686 A | | 11/1996 | Moody | |
| 5,636,812 A | | 6/1997 | Conner et al. | |
| 5,669,576 A | * | 9/1997 | Moody | 242/599.3 |
| 5,676,331 A | * | 10/1997 | Weber | 242/560 |
| 5,848,762 A | | 12/1998 | Reinheimer et al. | |
| 5,873,542 A | | 2/1999 | Perrin et al. | |
| 5,904,316 A | | 5/1999 | Dunning et al. | |
| 6,082,664 A | | 7/2000 | Phelps et al. | |
| 6,138,939 A | | 10/2000 | Phelps et al. | |
| 6,382,553 B1 | * | 5/2002 | Lewis et al. | 242/594.4 |
| 6,386,479 B1 | * | 5/2002 | Lewis et al. | 242/594.4 |

OTHER PUBLICATIONS

Prior Art, Kimberly–Clark—Coreless Adapter, Sep. 2001.

* cited by examiner

*Primary Examiner*—William A. Rivera
(74) *Attorney, Agent, or Firm*—Dority & Manning

(57) ABSTRACT

Adapters according to the invention are configured for solid or coreless rolls of material dispensed in a roll dispenser. The dispenser has slots defined on the side walls thereof along which the adapters move. The adapters include a carriage having opposite side members attached to a transverse support arm. A pin is disposed on the outboard surface of each side member and engages in the slots defined in the dispenser side walls. A protrusion is disposed on an inboard surface of each side member and engages at least partially into a recess or divot formed in the sides of the solid or coreless roll.

22 Claims, 6 Drawing Sheets

CORELESS ROLL PRODUCT ADAPTER AND DISPENSER

BACKGROUND

A fairly recent development in the industry of rolled paper products is solid or "coreless" rolls of material, such as bathroom tissue paper. Generally, these solid or coreless rolls are wound completely of the paper material and do not contain a hollow core or spindle of any type. A divot or recess may be formed in each side of the paper roll at the rotational axis for the roll.

Dispensers for multiple rolls of paper material, such as rolls of bathroom tissue, are also well known in the art. With conventional dispensers of this type, two rolls of tissue may be oriented generally vertically within the dispenser. A mechanical "catch" or lever is provided so that the top roll falls into a dispensing position when the bottom roll is sufficiently depleted. Generally, these conventional dispensers are configured for conventional "cored" rolls incorporating a hollow core and a spindle which extends through the rolls and into slots or pathways defined in the sides of the dispensers.

These conventional dispensers suffer the disadvantage of being incapable of dispensing multiple rolls of the solid or coreless rolls because they cannot hold the coreless rolls within the dispensers and maintain the rolls in proper alignment.

Advances have been made in the art to adapt certain types of conventional cored roll dispensers for use in dispensing solid or coreless rolls of material. For example, U.S. Pat. No. 6,082,664 describes adapters for dispensing solid or coreless rolls of paper material from conventional dispensers. The adapters include a protrusion that engages in the recess or divot defined in the sides of the coreless rolls and an engaging member having a size and shape so as to fit into and slide within the slots defined in the side walls of the dispenser. A pair of the adapters engage and hold the coreless roll within the dispenser and allow for the roll to move along the slots to a dispensing position. The adapters permit multiple coreless rolls to be dispensed by dispensers originally configured for conventional hollow core roll products.

The present invention relates to an alternative type of adapter for converting a conventional hollow core roll dispenser into a solid or coreless roll dispenser.

SUMMARY

Objects and advantages of the invention will be set forth in part in the following description, or may be obvious from the description, or may be learned through practice of the invention.

The present invention provides an adapter for solid or coreless rolls of paper material, such as bathroom tissue, so that such rolls may be dispensed in a roll dispenser of the type having slots or channels defined on inner side wall members thereof. The solid or coreless rolls may have recesses or divots defined in the vertical sides thereof that also define a rotating axis for the rolls. The adapters allow for dispensing of such coreless or solid rolls of material in conventional dispensers initially designed for dispensing hollow core rolls of material wherein a spindle extended through the hollow core and engaged in the side slots of the dispenser.

The adapters include a carriage member having opposite side members attached to a generally transverse support arm.

In one particular embodiment, the transverse support arm and side members are formed as an integral molded plastic component. However, it should be appreciated, that the type of material or forming process for making the adapters is not a limiting feature of the invention.

The transverse support arm has a length so that the side members extend generally parallel along the sides of the coreless roll when such a roll is engaged with the carriage. A pin is disposed on the outboard surface of each side member. This pin has a shape and a length so as to extend into and slide along the slots defined in the dispenser side walls. A protrusion is disposed on the inboard surface of each of the side members. This protrusion has a shape and a length so as to extend at least partially into the recess or divot formed in the sides of the solid or coreless rolls. The protrusion and pin may be coaxially disposed.

The pin and protrusion are disposed on the side members at a distance from the transverse support arm at least as great as the radius of the solid or coreless roll intended to be dispensed.

In one embodiment, the side members comprise plate-like components having angled outer edge surfaces that define an apex. The pin and protrusion may be disposed generally near or at the apex. For example, the side members may comprise generally V-shaped components with the pin and protrusion disposed at the apex of the legs forming the V-shape. In this embodiment, the V-shape is defined by first and second legs disposed at a non-zero angle with respect to each other. This angle may be between about 45 degrees to about 135 degrees. The first and second legs may generally be about the same length. The transverse support arm may extend between ends of the first legs. The other leg or angled edge surface may also have a length measured from the apex that is at least as great as the radius of the solid or coreless roll of material to be dispensed. The end of the second leg may include oppositely angled surfaces generally defining a point at the end of the leg. These angled surfaces act as bearing surfaces, as described in greater detail herein. The end of the first leg may comprise a generally flat end that is disposed at an angle less than 90 degrees with respect to a horizontal axis of the first leg. This flat end also acts as a bearing surface, as described in greater detail herein.

The present invention may also include a dispenser for storing and dispensing multiple rolls of solid or coreless rolls of material. The dispenser incorporates the unique adapter of the invention. Desirably, the dispenser includes a frame having side wall members and a front with a dispensing opening therein. The side wall members have generally vertically oriented and oppositely facing slots defined on the inside surfaces thereof. These slots may have varying angled segments, but extend generally vertically within the dispenser. The slots define a first dispensing position for dispensing a first roll of material, a storage position for a second roll of material in the dispenser above the first roll, and a second dispensing position wherein the stored roll is dispensed after the first roll has reached an essentially depleted state.

The dispenser includes interchangeable first and second adapters that are removeably insertable into the slots for holding the first and second rolls respectively in position within the frame. The adaptors are configured as discussed above.

In the first dispensing position of the first roll of material, a first adapter is oriented in a first angular position. In the storage position of the second roll of material, the second adapter (identical in configuration to the first adapter) is oriented in a different angular position as compared to the angular position of the first adapter. The adapters are interchangeable as either the first or second adapter.

In one embodiment, in the first dispensing position of the first roll of material, the first adapter is oriented so that its transverse support arm is below a rotational axis of the first roll of material. In the storage position of the second roll of material, the second adapter is oriented so that its transverse support arm is above the rotational axis of the second roll of material. In the dispensing position of the first roll, the adapter pivots or rotates as the first roll is depleted and its radius decreases. At some point, the first roll will be depleted to an extent that an edge, for example the edge of the first leg of the V-shaped side member, comes to lie against a bottom surface of the dispenser frame. At this position, the second adapter and second roll material move from the storage position to the second dispensing position.

The second dispensing position is above the first dispensing position, and the first adapter contacts and supports the second adapter in the second dispensing position. For example, in the embodiment wherein the side members are a V-shaped component, the second leg of the V-shape is oriented generally upwards or vertically when the first adapter is at the depleted position of the first roll and the first leg of the V-shaped component lies against the bottom of the dispenser frame. The vertically extending second leg contacts the respective second leg of the second adapter and thus supports the weight of the adapter and second roll within the frame. The second roll is dispensed from this position within the frame.

The second adapter may have generally the same angular orientation in the storage position as in the second dispensing position. In other words, the second adapter need not rotate as it moves from the storage position to the second dispensing position.

The first leg or angled edge surface of the side members may have a length so as to contact against a back wall of the frame in the storage position and second dispensing position.

The second leg or second angled edge surface of the side members may have a generally pointed end defined by oppositely angled surfaces wherein one such angled surface acts as a bearing surface against a front wall of the dispenser as the adapter is held in the storage position and moves to the second dispensing position. When the adapter is used with the first roll of material in the first dispensing position, the opposite angled surface acts as a bearing surface against the second leg or second angled surface of the second adapter in the second dispensing position.

The invention will be described in greater detail below through use of the appended drawings.

DETAILED DESCRIPTION

Figure 1:
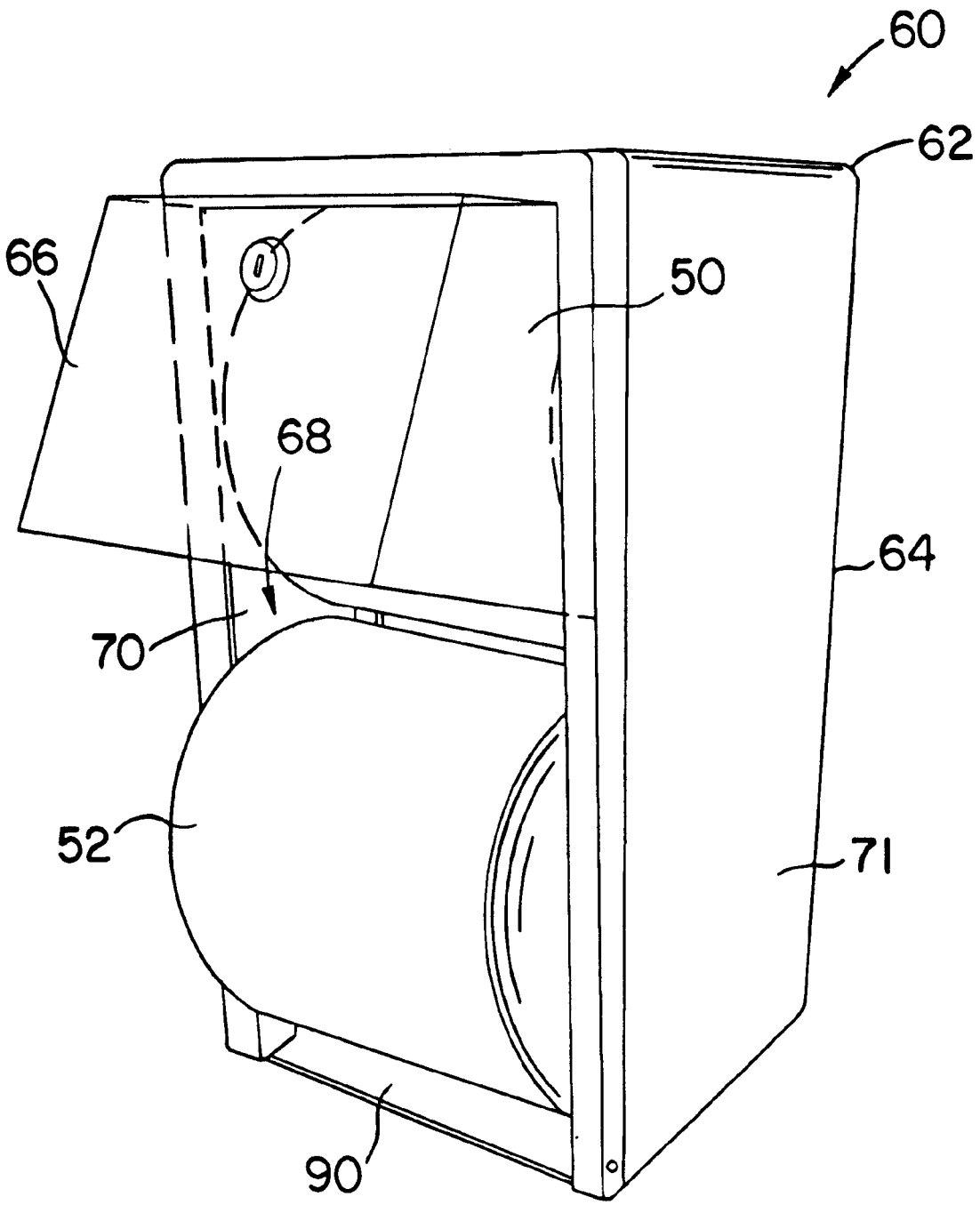
FIG. 1 is a perspective view of a dispenser for dispensing multiple rolls of solid or coreless rolls of material.

Reference will now be made in detail to various embodiments of the invention, one or more examples of which are illustrated in the drawings. Each example is provided by way of explanation of the invention, and not meant as a limitation of the invention. For example, features illustrated or described as part of one embodiment can be used in another embodiment to yield still a further embodiment. It is intended that the present invention include these and other modifications and variations coming within the scope and spirit of the invention.

The present invention will be described and illustrated as it relates to solid or coreless rolls of bathroom tissue. However, it should be appreciated that the present invention has uses in any application wherein solid or coreless rolls of material, and not necessarily paper material, are to be dispensed from a dispensing device. Other materials include, for example, non-woven fabrics, films, textiles, screens, meshes, and composites or laminates including one or more of the above.

The term "coreless" refers to solid-wound rolls not having a hollow tube or core with a spindle device inserted therethrough. However, a solid or non-hollow core member is within the scope and spirit of the invention.

FIG. 1 conceptually illustrates aspects of the present invention. An exemplary dispenser 60 is shown, which is formed of a frame 62 having side walls 64. The side walls 64 have an outer surface 71 and an inner surface 70. The inner surface 70 may be defined by a piece of sheet metal or like material that is spaced inwardly from the outer surface 71. The dispenser 60 includes a front cover member, generally 66, that pivots away from the frame 62 for loading rolls of material into the frame. The cover 66 defines a dispensing opening 68 wherein a lowermost roll of material 52 is exposed for grasping and dispensing by a user. In an alternative embodiment, a bottom 90 of the dispenser frame 60 may include an opening that defines the dispensing position for the lowermost roll.

Figure 2:
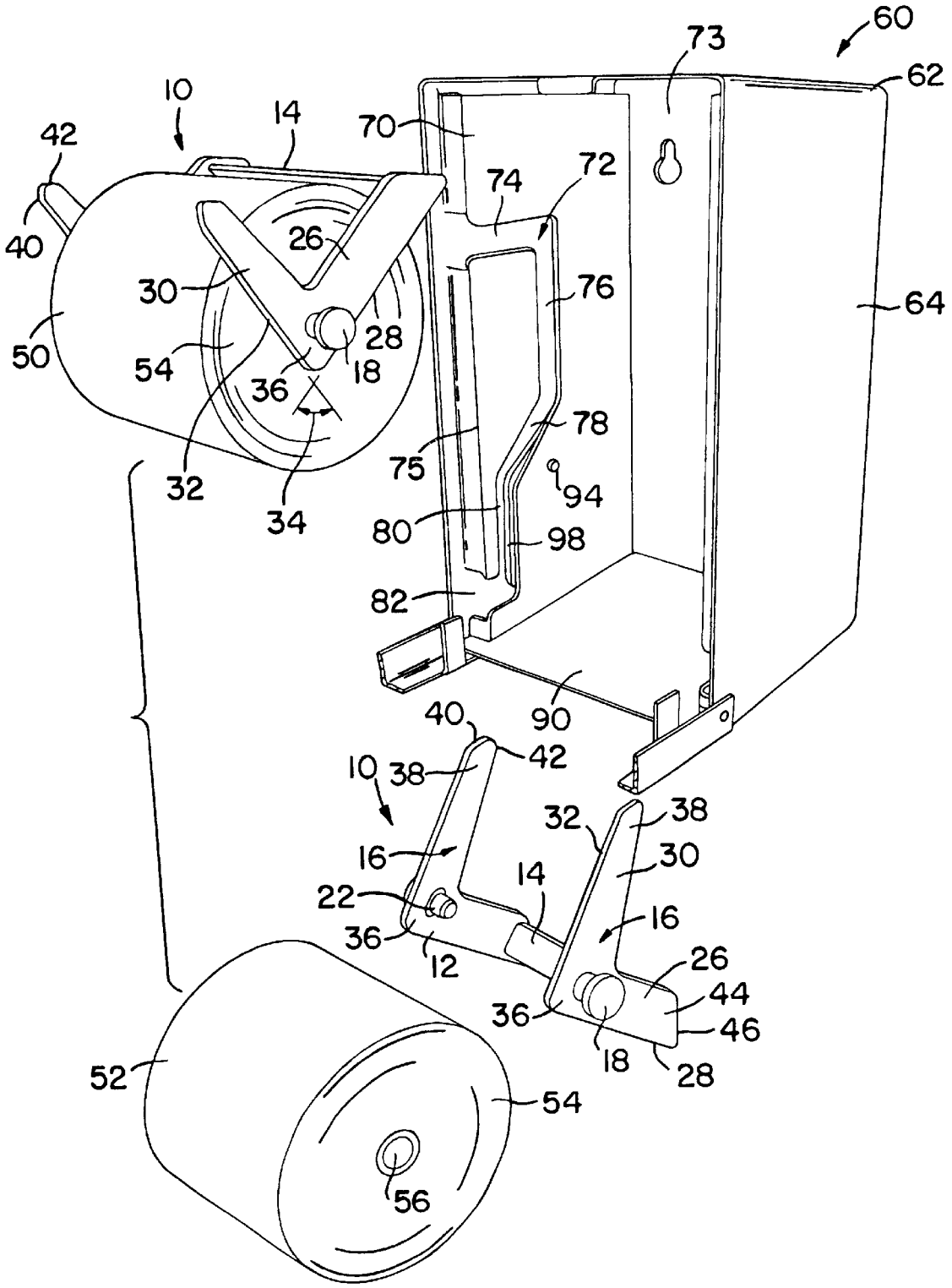
FIG. 2 is a partial component view of the dispenser shown in FIG. 1 particularly illustrating the adapters according to the present invention.
Figure 3A:
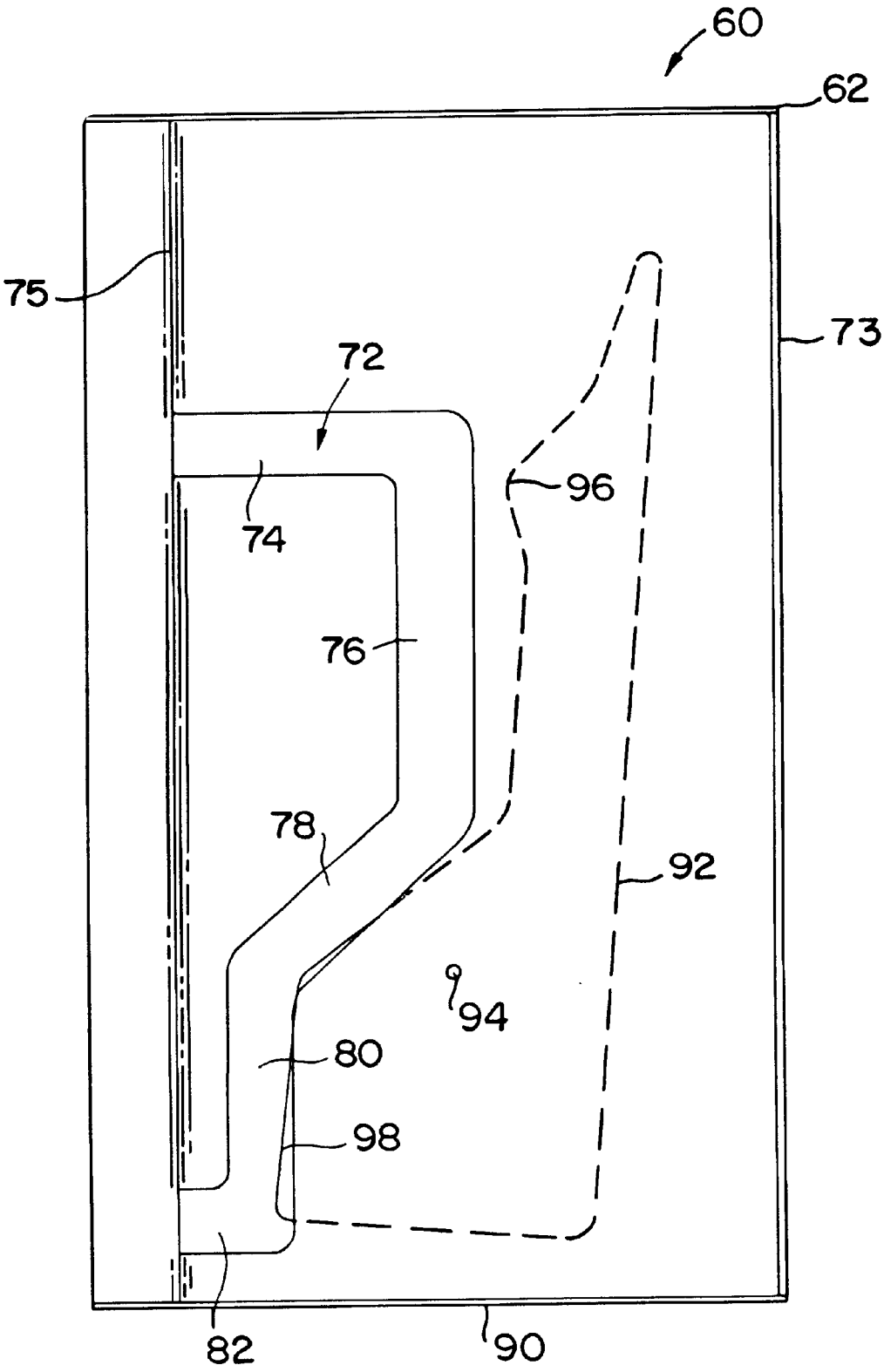
FIG. 3*a* is a cutaway side view of the dispenser particularly illustrating the configuration of the side slot and the lever arm in dashed lines.

Referring to FIGS. 2 and 3*a* in particular, the dispenser 60 includes generally vertically oriented and oppositely facing slots 72 disposed within the frame 62 on the inside wall surfaces 70. In the illustrated embodiment, the frame 62 includes a sheet metal structure 75 defining the inside surface 70 of the walls, and the slots 72 are defined by a channel cut through the sheet metal material 75. The slots are generally "vertical" in that they extend from a top portion of the dispenser frame 62 to a lower portion of the dispenser frame. The slots 72 may have various angles and sections between the top and bottom of the dispenser frame. For example, the slots 72 may include a generally horizontal upper section 74 that acts as an initial loading section for insertion of an adapter and coreless roll. A first vertical section 76 is followed by an angled section 78 and a second vertical section 80. A bottom generally horizontal section 82 defines a lowermost portion of the slots 72. It should be readily apparent that the slots 72 may have various shapes or configurations.

The solid or coreless rolls of material 50, 52 are held within the dispenser by engagement of adapters 10 within the slots 72, as will be described in more detail below.

Figure 3B:
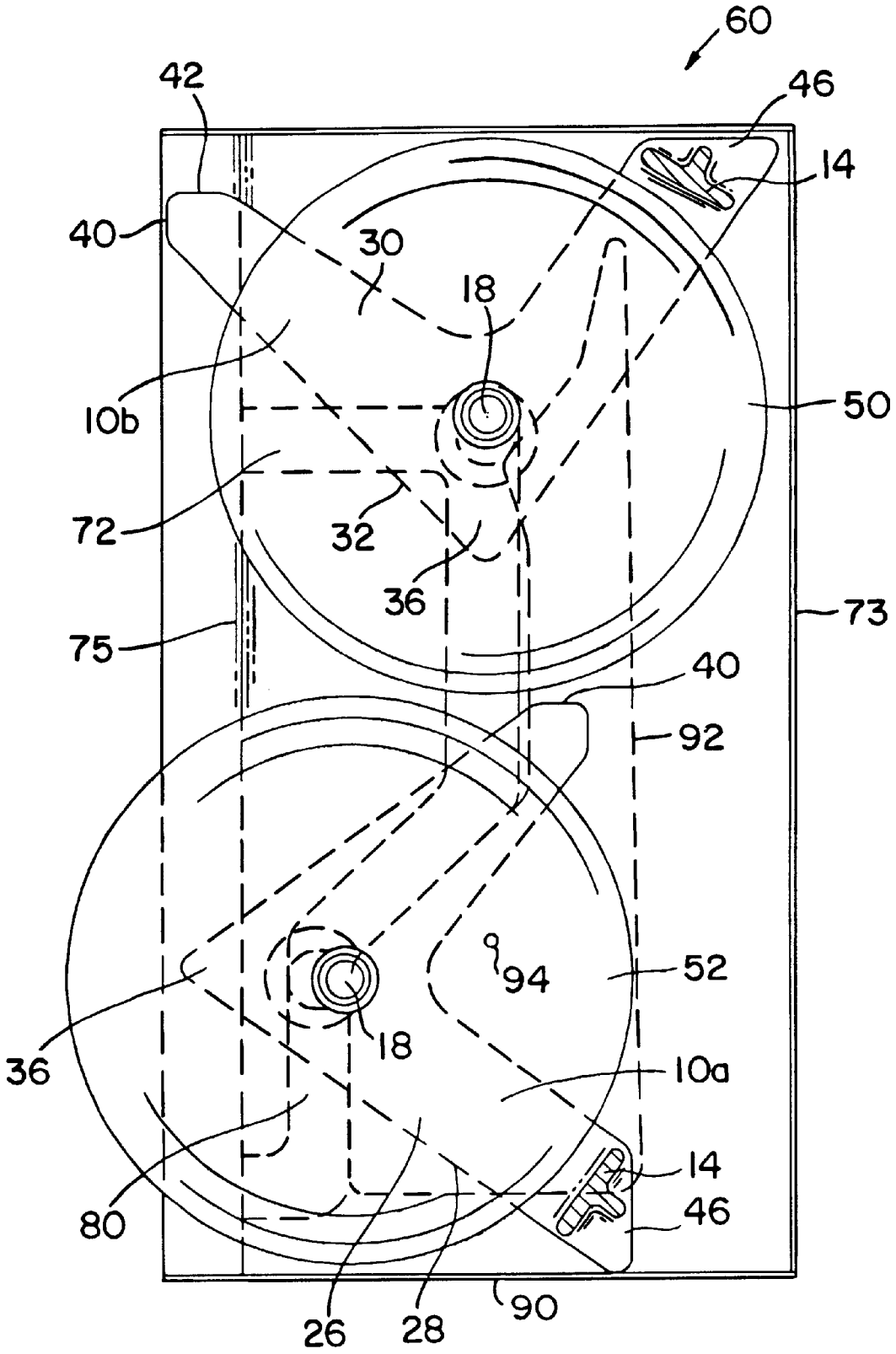
FIG. 3*b* is a cutaway view of the dispenser illustrating a first coreless roll of material in its dispensing position and a second coreless roll of material in a stored position.
Figure 3C:
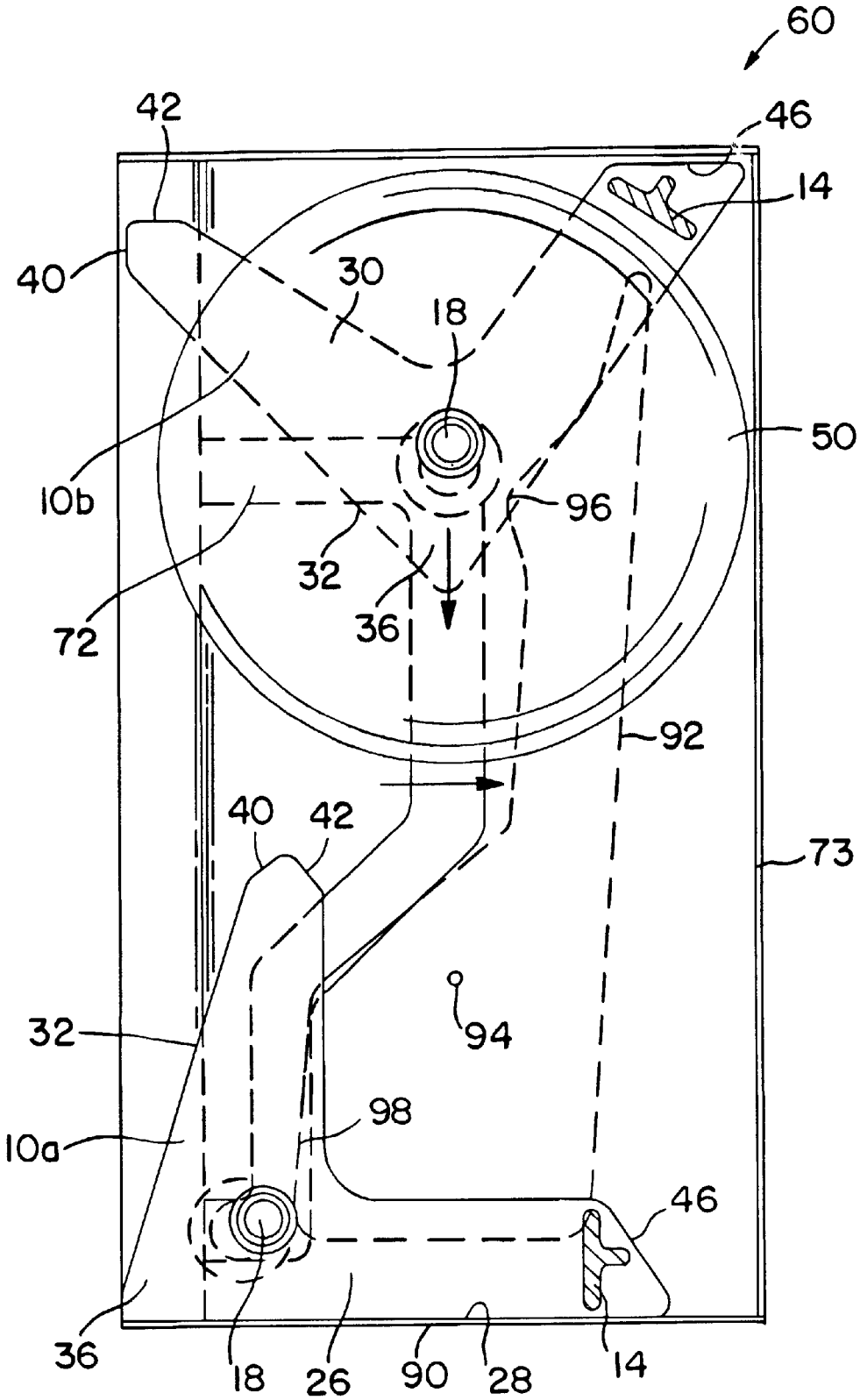
FIG. 3*c* is a cutaway view of the dispenser particularly illustrating the orientation of the first adapter upon depletion of the first coreless roll of material and movement of the second adapter and the second roll of material from the stored position to the second dispensing position.

Referring to FIG. 3*a* in particular, an additional feature of the dispenser 60 is a rocker arm or lever 92 housed within the frame 62 between the side walls 64 and sheet metal member 75. The rocker arm 92 is pivotal about a pivot point 94. The operation of the rocker arm 92 is understood by those skilled in the art. Generally, the rocker arm 92 serves to hold an upper roll of material 50 in a storage position above the dispensing position of a lower roll 52, as shown in FIG. 3*b,* until the lower roll has been substantially depleted. The rocker arm 92 includes a catch or stop 96 disposed so as to engage and hold a spindle (or the adapter 10 according to the invention) associated with the upper roll 50. The adapter 10 associated with the lower roll 52 in the dispensing position illustrated in FIG. 3*b* pushes an edge or wall 98 of the rocker arm 92 causing the rocker arm to pivot counter-clockwise in the view illustrated in the figures so that the catch 96 holds the upper adapter 10*b* in the storage position illustrated in FIG. 3*b*. Once the lower roll 52 has been sufficiently depleted, the lower adapter 10*a* moves to its depleted orientation illustrated in FIG. 3*c* wherein an outboard engaging pin 18 of the adapter 10*a* moves into the bottom section 82 of the slot 72. At this position, the rocker arm 92 is allowed to pivot clockwise, as illustrated in FIG. 3*c,* and the upper adapter 10*b* is free to slide downward along the first vertical section 76 of the slot 72 until it reaches its dispensing position illustrated in FIG. 3*d*. This sequence of events will be described in greater detail below.

A more detailed explanation of the dispenser frame and components is not particularly necessary for purposes of the present disclosure. Such conventional dispensers have typically been used to dispense multiple vertical rolls of tissue paper having hollow cores. Generally, a spindle is inserted through the hollow cores and engages in each of the slots 72, as is well understood by those skilled in the art. One of the goals of the present invention is to configure the inventive adapters for use with such conventional dispensers. The present adapters are particularly suited for use with a multiple roll dispenser from Bradley of Menomonee Falls, Wis. The adapters may also be useful with multiple roll dispensers manufactured by ASI of Yonkers, N.Y.; Bobrick of Los Angeles, Calif.; and McKinney Essex of Scranton, Pa. The dispensers of these companies and others are all similar in operation in that they define slots or pathways on the inside surface of the side walls in order to load, store, and dispense multiple rolls of bathroom tissue. The dispenser 60 illustrated in the figures is generally representative of a Bradley multiple roll dispenser.

Figure 3D:
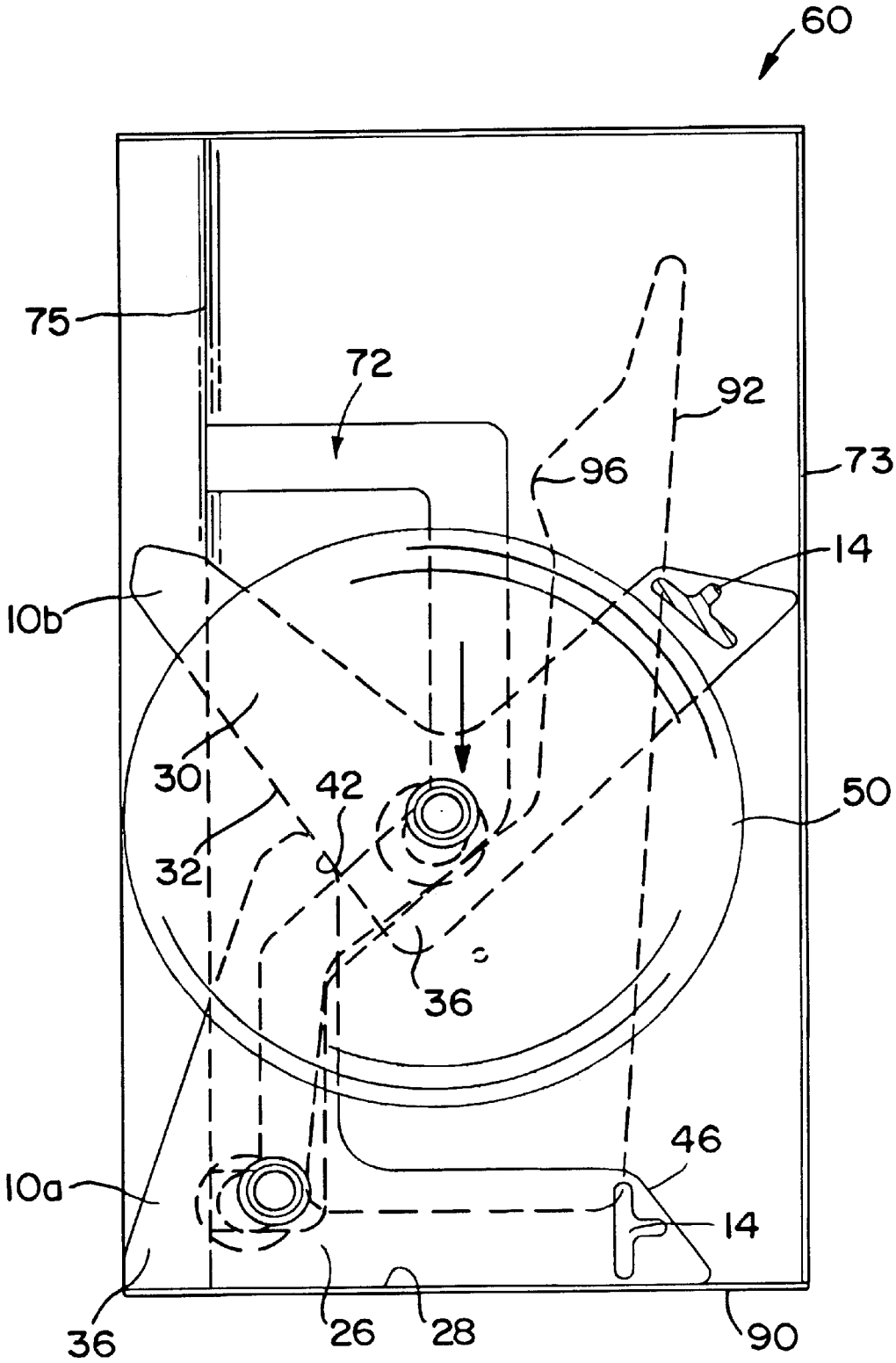
FIG. 3*d* is a cutaway perspective view of the dispenser particularly illustrating the second adapter and second coreless roll of material in the second dispensing position.

The adapters 10 according to the invention are shown in particular detail in FIGS. 2 through 3*d*. One such adapter 10 is provided for each roll stored in the dispenser 60. For example, in the illustrated embodiment, the dispenser 60 stores a first coreless roll 52 in a dispensing position and a second coreless roll 50 in a stored position generally above the dispensing position of the first roll. The adapters 10 are interchangeable in that either adapter may be used for either roll of material. In the illustrated embodiment, an upper adapter 10*b* is associated with the upper roll of material 50, and a lower adapter 10*a* is associated with the roll of material 52 in the first dispensing position.

The adapters 10 according to the invention may take on various shapes and configurations for fulfilling their intended purpose. In the illustrated embodiment, each adapter 10 is formed as a carriage 12 having a transverse support arm 14 attached to opposite side members 16. The side members 16 extend generally perpendicular from the support arm 14. The side members 16 may be defined as relatively thin plate-like members. The transverse support arm 14 has a length so that the side members 16 extend generally parallel along the flat sides 54 of the coreless rolls 50, 52. A pin 18 is disposed on an outboard surface 20 of each side member 16. This pin 18 may take on various shapes and configurations but generally has a size and shape so as to extend into and slide along the slots 72 defined in the dispenser side walls 64. A protrusion 22 is disposed on an inboard surface 24 of each side member 16. This protrusion has a shape and a length so as to extend at least partially into a recess or divot 56 formed in the flat sides 54 of the coreless rolls 50, 52. The recess or divots 56 define the rotational axis of the rolls 50, 52. The protrusion 24 may take on various shapes and configurations so long as it extends at least partially into the recesses or divots 56 and does not unnecessarily inhibit rotation of the coreless rolls relative to the adapters 10.

The side members 16 may have any number of overall shapes or configurations. In general, each side member 16 has a first edge surface 28 and a second edge surface 32 disposed at a non zero angle 34 (FIG. 2) with respect to the first edge surface 28. The angle 34 may vary and depends on the particular type of structure of the dispenser 60. For example, the angle 34 may vary from between about 45 degrees to about 135 degrees. In the illustrated embodiment, the angle 34 is about 75 degrees. The angle is such that when the adapter 10 is in the depleted position of the first roll of material 52, for example the position of adapter 10*a* in FIG. 3*c,* the second edge surface 32 extends generally upwards towards the upper or reserve roll 50. The edge surfaces 28 and 32 define an apex 36. The pins 18 and protrusions 22 are disposed generally at or near this apex 36. The pins 18 and protrusions 22 may be coaxially aligned at the apex 36.

The pins 18 and protrusions 22 are disposed at a distance from the transverse support arm 14 that is at least as great as a radius of the solid or coreless rolls to be dispensed, as particularly seen in FIGS. 2 through 3*d*. In this way, the adapters 10 are engaged with the coreless rolls such that the protrusions 22 engage in the roll recesses or divots 56 and the transverse support arm 14 extends longitudinally along the outer circumferential surface of the rolls.

In a particularly desirable embodiment of the adapters 10, the carriage member is formed as a molded plastic component wherein the side members 16, pins 18, protrusion 22, and transverse support arm 14, are integrally molded as a single component.

In one particular embodiment illustrated in the figures, the side members 16 are formed as generally V-shaped components having a first leg 26 defining the edge surface 28 and a second leg defining the edge surface 32. The first and second legs 26, 30, may be of substantially equal length. The legs 26, 30, meet at the apex 36. The ends of the legs 26, 30, may be formed with variously shaped bearing surfaces that aid the adapters 10 in movement along the slots 72, among other things. For example, the second leg 30 may have an end 38 defined by oppositely angled surfaces 40, 42. The surfaces 40, 42 generally define a point at the leg end 38. When the adapter 10 is used to support a roll in the storage position, such as the adapter 10*b* shown in FIG. 3*b,* the angled surface 40 may act as a flat bearing surface against a front cover component or wall of the dispenser frame. When the adapter 10 is used to support a lower roll 52 in a dispensing position, as is the adapter 10*a* in FIG. 3*b,* the opposite angled surface 42 will act as a bearing surface to support the upper adapter 10*b* and upper roll 50 once the lower roll has been depleted, as illustrated in FIG. 3*d*.

The first leg 26 may have an end 44 defined by a single flat surface 46. This surface 46 may act as a bearing surface when the adapter 10 is used to hold the upper roll 50 in its storage position, as illustrated in FIG. 3*b*. The surface 46 may bear against a top wall or surface of the dispenser frame 62.

FIGS. 3*b* through 3*d* show sequential operational views of the dispenser 60 and adapters 10*a*, 10*b*. FIG. 3*b* illustrates a lower coreless roll 52 held in a first dispensing position by an adapter 10*a*. The pin 18 engages within slot 72 generally at or near the top of the second vertical section 80. As discussed above, the pins 18 of the first adapter 10*a* engage against the wall 98 of the rocker arm 92 causing the catch 96 to be rotated into the slot 72. The position of the catch 96 defines the storage position for the second adapter 10*b* and its respective roll of material 50, as particularly seen in FIG. 3*b*.

The rolls of material with respective adapters 10*a*, 10*b* are initially loaded into the dispenser 60 by sliding the first adapter 10*a* into the slot 72 along the horizontal section 74. The first adapter 10*a* and roll 52 are manually guided along the slot 72 until the first adapter 10*a* is at the position illustrated in FIG. 3*b*. This position defines the first dispensing position for the roll 52. The second adapter 10*b* and respective roll 50 are then slid into the slot 72 until engaged by the catch 96 of the rocker arm 92.

As the first roll of material 52 is depleted, the radius of the roll decreases and the adapter 10*a* drops within the second vertical section 80 of the slot 72 until the edge surface 28 of the first leg 26 lies generally flat against the bottom 90 of the dispenser frame, as indicated in FIG. 3*c*. In this position, the pins 18 of the first adapter 10*a* move out of contact with the wall or edge 98 of the rocker arm 92 and the catch 96 moves out of engagement with the pins 18 of the first adapter 10*b*. Once this occurs, the second adapter 10*b* and its respective roll 50 fall into the second dispensing position illustrated in FIG. 3*d*. In this position, the angled surfaces 42 of the first adapter 10*a* contact the edge surface 32 of the side member second leg 30, as particularly illustrated in FIG. 3*d*. In this manner, the second adapter 10*b* and its respective roll 50 are completely supported by the lower adapter 10*a*. Thus, the second dispensing position is above the first dispensing position. It may very well be that a portion of the first roll 52 remains when the first adapter 10*a* is in the depleted position illustrated in FIG. 3*d*. This portion of the roll is still available to be dispensed when the second roll 50 has dropped to the second dispensing position.

It should thus be appreciated that the adapters 10*a* and 10*b* are identical and interchangeable with respect to their position within the dispenser 62.

Referring to FIG. 3*b*, the first adapter 10*a* at the first dispensing position has a first angular orientation or position that is different from the second adapter 10*b*. For example, the transverse support arm 14 lies below the axis of roll 52 and the apex 36 of the first adapter 10*a* points towards the front of the dispenser 60 and gradually lowers as the first roll material 52 is depleted. The final orientation of the adapter 10*a* is illustrated in FIG. 3*d*. On the other hand, the second adapter 10*b* assumes an initial orientation in the storage position of the second roll 50 wherein the support arm 14 is above the axis of roll 50 and the apex 36 is oriented generally downward. The second adapter 10*b* maintains this orientation as it moves from the storage position to the second dispensing position illustrated in FIG. 3*d*. It should be appreciated that the adapters are uniquely configured to act in either position so that a maintenance technician need not be concerned with different types of adapters for the different respective rolls within the dispenser.

It should be appreciated by those skilled in the art that various modifications and variations can be made in the present invention without departing from the scope and spirit of the invention, particularly as to the configuration of the adapters. Additionally, although the inventive adapters are described and illustrated as utilized in a particular type of dispenser, it is within the scope and spirit of the invention that the adapters be used with any type of dispenser wherein multiple rolls of solid or coreless material are housed and moved in the dispenser to a dispensing position. It is intended that the present invention include such modifications and variations as come within the scope of the appended claims and their equivalents.

What is claimed is:

1. An adapter for solid or coreless rolls of paper material dispensed in a roll dispenser having slots defined on inner side wall members, the solid or coreless rolls having recesses provided in sides thereof defining a rotating axis for the rolls, said adapter comprising:

a carriage having opposite side members attached to a generally transverse support arm;

said transverse support arm having a length so that said side members are extendable generally parallel along the sides of a solid or coreless roll when said carriage member is engaged with the roll;

a pin disposed on an outboard surface of each said side member and having a shape and length so as to extend into and slide along the slots defined in the dispenser side walls;

a protrusion disposed on an inboard surface of each said side member, said protrusions having a shape and length so as to extend at least partially into the recesses formed in the sides of the solid or coreless rolls;

said side members comprising a first leg and a second leg disposed at an angle of between about 45 degrees to about 135 degrees to said first leg, said transverse support arm extending between a first end of said first legs, and said pin and protrusion located at an apex of said first and second legs at a distance from said transverse support arm at least as great as a radius of the solid or coreless roll to be dispensed; and wherein said second legs have a length at least as great as a radius of the solid or coreless roll to be dispensed.

2. The adapter as in claim 1, wherein said carriage member is a molded plastic component.

3. The adapter as in claim 1, wherein said first and second legs are generally about the same length.

4. The adapter as in claim 1, wherein said second leg comprises a generally pointed end defined by oppositely angled surfaces.

5. The adapter as in claim 1, wherein said first leg comprises a flat end disposed at an angle less than 90 degrees with respect to a horizontal axis of said first leg.

6. An adapter for solid or coreless rolls of paper material dispensed in a roll dispenser having slots defined on inner side wall members, the solid or coreless rolls having recesses provided in sides thereof defining a rotating axis for the rolls, said adapter comprising:

a carriage having opposite side members attached to a generally transverse support arm, said side members comprising generally plate-like components;

said transverse support arm having a length so that said side members are extendable generally parallel along the sides of a solid or coreless roll when said carriage member is engaged with the roll;

a pin disposed on an outboard surface of each said side member and having a shape and length so as to extend into and slide along the slots defined in the dispenser side walls;

a protrusion disposed on an inboard surface of each said side member, said protrusions having a shape and length so as to extend at least partially into the recesses formed in the sides of the solid or coreless rolls;

wherein said pin and protrusion of said side members are disposed at a distance from said transverse support arm at least as great as a radius of the solid or coreless roll to be dispensed; and wherein said side members comprise angled outer edge surfaces that define an apex, said pin and protrusion disposed generally at said apex; and wherein said transverse support arm is disposed adjacent an end of one said angled edge surface, and said other angled edge surface has a length measured from said apex at least as great as a radius of the solid or coreless roll to be dispensed.

7. The adapter as in claim 6, wherein said side members comprise a generally V-shaped configuration.

8. The adapter as in claim 6, wherein said angled edge surfaces have generally about the same length.

9. The adapter as in claim 6, wherein said pin and protrusion are coaxial.

10. A dispenser for storing and dispensing multiple rolls of a solid or coreless roll of material, comprising:

a frame having side wall members and a front with a dispensing opening therein, said side wall members having generally vertically oriented and oppositely facing slots defined on inside surfaces thereof, said slots defining a first dispensing position for dispensing of a first roll of material, a storage position for a second roll of material stored above said first roll until said first roll is depleted, and a second dispensing position for dispensing said second roll;

interchangeable first and second adapters removably insertable into said slots for holding said first and second rolls respectively in position within said frame, each said adapter comprising:

a carriage having opposite side members attached to a generally transverse support arm, said side members comprising generally plate-like components spaced apart a distance so as to extend generally parallel along sides of the rolls;

a pin disposed on an outboard surface of each said side member and having a shape and length so as to extend into and slide along a respective said slot;

a protrusion disposed on an inboard surface of each said side member and having a shape and length so as to extend at least partially into a recess formed in the sides of the rolls at a rotational axis thereof;

said pins and protrusions disposed at a distance from said transverse support arm at least as great as a radius of the rolls; and wherein in said first dispensing position of said first roll of material, said first adapter is oriented in a first angular position, and in said storage position of said second roll of material, said second adapter is oriented in a different angular position.

11. The dispenser as in claim 10, wherein in said dispensing position of said first roll of material, said first adapter is oriented so that said transverse support arm is below a rotational axis of said first roll of material, and in said storage position of said second roll of material, said second adapter is oriented so that said transverse support arm is above the rotational axis of said second roll of material.

12. The dispenser as in claim 11, wherein said first adapter pivots as said first roll of material is depleted.

13. The dispenser as in claim 12, wherein said first adapter pivots as said first roll is depleted until an edge of said adapter lies against a bottom of said frame, at which position said second adapter and roll of material move to said second dispensing position.

14. The dispenser as in claim 13, wherein said first adapter contacts and supports said second adapter in its second dispensing position.

15. The dispenser as in claim 14, wherein said second adapter has generally the same angular orientation in said storage position and said second dispensing position.

16. The dispenser as in claim 10, wherein said side members comprise first and second outer angled edge surfaces that define an apex, said pin and protrusion disposed generally at said apex.

17. The dispenser as in claim 16, wherein said side members comprise a generally V-shaped configuration.

18. The dispenser as in claim 16, wherein said transverse support arms are disposed adjacent an end of said first angled edge surface, and said second angled edge surface has a length measured from said apex at least as great as a radius of the rolls of material.

19. The dispenser as in claim 18, wherein said first and second angled edge surfaces have generally about the same length.

20. The dispenser as in claim 18, wherein said second angled edge surface extends generally vertically when said first angled edge surface is horizontal.

21. The dispenser as in claim 16, wherein said first angled edge surface has a length so as to contact against a back wall of said frame in said storage position and said second dispensing position.

22. The dispenser as in claim 17, further comprising a pivotal lever disposed in at least one side wall of said frame, said lever holding said second adapter in said storage position until said first adapter moves to a depleted position of said first roll, whereupon said lever pivots allowing said second adapter to move downward in said slots.

* * * * *